US010577229B2

(12) United States Patent
Huang

(10) Patent No.: US 10,577,229 B2
(45) Date of Patent: Mar. 3, 2020

(54) POWER WINCH FOR MOTOR VEHICLES

(71) Applicant: Comeup Industries Inc., Taipei (TW)

(72) Inventor: Shih-Jyi Huang, Taipei (TW)

(73) Assignee: Comeup Industries Inc., Taipei (TW)

( * ) Notice: Subject to any disclaimer, the term of this patent is extended or adjusted under 35 U.S.C. 154(b) by 59 days.

(21) Appl. No.: 15/885,891

(22) Filed: Feb. 1, 2018

(65) Prior Publication Data

US 2019/0233262 A1 Aug. 1, 2019

(51) Int. Cl.
*B66D 1/28* (2006.01)
*B66D 1/12* (2006.01)
*B66D 1/46* (2006.01)

(52) U.S. Cl.
CPC ..... *B66D 1/28* (2013.01); *B66D 1/12* (2013.01); *B66D 1/46* (2013.01)

(58) Field of Classification Search
CPC . B66D 1/46; B66D 1/485; B66D 3/18; B66D 3/20; B66D 3/26; B66D 2700/0125
See application file for complete search history.

(56) References Cited

U.S. PATENT DOCUMENTS 4,475,163 A * 10/1984 Chandler ..... B66D 1/505 377/17
D497,714 S * 11/2004 To ..... D3/218
6,864,650 B2 * 3/2005 Heravi ..... B60P 3/12 318/266
7,063,306 B2 * 6/2006 Sanders ..... B66D 1/485 254/361
8,944,413 B1 * 2/2015 Hatch ..... B63C 3/06 254/323
9,975,742 B1 * 5/2018 Mason ..... B66D 1/46
D845,279 S * 4/2019 Huang ..... D14/218
2007/0221898 A1 * 9/2007 Giacomini ..... B66D 1/08 254/323
2013/0304278 A1 * 11/2013 Chen ..... G06F 17/00 701/2
2014/0257631 A1 * 9/2014 Heravi ..... B66D 1/42 701/36
2015/0284226 A1 * 10/2015 Hall ..... B66C 13/46 414/21
2015/0307332 A1 * 10/2015 Huang ..... B66D 1/28 254/323
2016/0046468 A1 * 2/2016 Heravi ..... B66D 1/40 715/835
2016/0318740 A1 * 11/2016 Kos ..... B66D 1/54
(Continued)

*Primary Examiner* — Emmanuel M Marcelo
(74) *Attorney, Agent, or Firm* — Alan D. Kamrath; Karin L. Williams; Mayer & Williams PC

(57) ABSTRACT

A power winch for motor vehicles includes a display panel for displaying the operation status of the power winch and letting users know whether or not the power winch is situated at an electrical connection status for use, the voltage of a vehicle power supply connected to the power winch, whether or not the power winch is connected to the wireless handheld controller normally, and whether a steel wire rope of the power winch is wound or unwound, so as to improve the safety of operation, control, and use. The power winch further includes a storage holder installed on a surface of the power winch for storing the wireless handheld controller to facilitate a quick access or use of the wireless handheld controller, so as to improve the convenience of operation, control and use.

7 Claims, 5 Drawing Sheets

(56) References Cited

U.S. PATENT DOCUMENTS

| | | | | |
|---|---|---|---|---|
| 2017/0062148 | A1* | 3/2017 | Legel | E01H 5/061 |
| 2017/0066634 | A1* | 3/2017 | Kawai | B66D 5/02 |
| 2019/0077642 | A1* | 3/2019 | Huang | B66D 1/58 |

* cited by examiner

POWER WINCH FOR MOTOR VEHICLES

BACKGROUND OF THE INVENTION

Field of the Invention

The present invention relates to a power winch, and more particularly to the power winch for motor vehicles capable of clearly showing the operation status of the power winch to improve the safety of use and storing a wireless handheld controller directly on a surface of the power winch to improve the convenience of use.

Description of the Related Art

In general, a power winch, also known as "hoist" or "lifting hoist" is a lifting power equipment for hoisting (pulling) or releasing a heavy object by winding or unwinding a steel wire rope by power. A conventional power winch is usually installed to a position for hoisting a heavy object (or goods) vertically up and down in a tall building, or installed on a jeep or an off-road vehicle for towing another vehicle or self-rescue (escape from danger). The conventional power winch includes a power source (such as a motor) installed on a side of the power winch, and its generated power is transmitted through an internal shaft to drive a deceleration device installed on an adjacent side or the other side of the power winch. The deceleration device goes through a plurality of decelerations (by a planetary gear set) and drives a rope pulley to rotate after the transmission, so that a steel wire rope wound onto the rope pulley can perform a forward-rotation release or a reverse-rotation winding action. In other words, the power winch controls the forward and reverse rotations of the rope pulley by power and further controls the winding or unwinding of the steel wire rope, which is the action of winding or unwinding the steel wire rope by power. The power winch further includes an electric control module, which is generally in the form of a box (and thus usually called an electric control box) electrically coupled to the power source, and a power switch installed on a surface of the power winch for controlling the electric connection (CLOSE) or disconnection (OPEN) between the power source and the external power supply (such as a motor vehicle battery). The electric control module may be coupled to a cable handheld controller through a plug socket via a cable connection, or the electric control module may be coupled to a wireless handheld controller for a wireless connection, so that the cable handheld controller or the wireless handheld controller can be connected to the electric control module online for an operation to achieve the effect of turning on or off the power source by remote control.

The present invention relates to a power winch installed on a motor vehicle for the use of escape and rescue, so that it is called the "power winch for motor vehicles". To save space and facilitate the operation, the power winch for motor vehicles primarily uses a wireless handheld controller for wireless operation and control. During the operation and control of the power winch for motor vehicles, it is necessary to know the current operation status of the power winch clearly, and this requirement is a very important safety requirement. For example, the so-called operation status includes the following: 1. The power winch for motor vehicles has to use the power supplied by the vehicle power supply (or battery), so it is necessary to know whether or not the voltage of the motor vehicle battery falls within an allowable range; 2. It is necessary to know whether or not the input or output direction of the steel wire rope is correct, particularly in an emergency. Knowing the moving direction of the steel wire rope is very important, and any confusion of such direction gives rise to a safety issue; 3. It is necessary to know whether or not the connection between the handheld controller and the power winch is normal, as an abnormal connection also results in a safety issue. Therefore, it is very important for users to know the current operating status of the power winch clearly while operating the power winch. However, the conventional power winch for motor vehicles typically has only a power switch installed on the main body of the power winch, but have no other parts or mechanisms for showing the operation status, so that operators can control the power winch visually based upon their experience only. Obviously, the safety of the conventional power winch is low.

In addition to the importance of knowing the operation status of the power winch for motor vehicles, the storage of the wireless handheld controller is also an important subject, because both of the power winch and the wireless handheld controller are two standalone devices, so that when they are not in use, the wireless handheld controller is usually stored into a storage space of the motor vehicle, but there are several storage spaces of the motor vehicle for storing a number of miscellaneous objects, and it is relatively difficult for the users to find the wireless handheld controller for an emergency use. Typically, users are anxious and impatient to find the controller in an emergency, or the controller is stored somewhere else. No matter of which case, the wireless handheld controller is not stored at a fixed position to facilitate quick access and use. Obviously, the conventional power winch for motor vehicles requires improvements.

SUMMARY OF THE INVENTION

To overcome the drawbacks of the conventional structure, the inventor of the present invention conducted extensive research and development, and provided a power winch for motor vehicles in accordance with the present invention.

It is a primary objective of the present invention to overcome the drawbacks of the prior art by providing a power winch for motor vehicles that that can clearly show the operation status of the power winch to improve the safety of use.

Another objective of the present invention is to provide a power winch for a motor vehicle that can store a wireless handheld controller directly on a surface of the power winch to facilitate accessing the power winch quickly.

To achieve the above mentioned objectives, the present invention is provided with a power winch for motor vehicles, capable of driving a rope pulley to rotate after power generation by an internal power source and the action of a deceleration mechanism, so as to release or wind a steel wire rope wound around the rope pulley through a steel wire rope exit. The power winch includes a storage holder installed thereon and is provided for storing a wireless handheld controller in the storage holder.

According to the above described power winch for motor vehicles, the storage holder includes a storage box, a binding block and a support block, and a storage space at the front side of the storage box defined by a lower arc wall connected to both sides and extended forward and a support plate extended forward from the bottom side, the front edge of the lower arc wall is bent inwardly into a small section of protective wall, and the support plate has a bracket disposed at the top of the support plate and extended towards both sides of the support plate. The bracket includes a slight flange used for positioning, a pressing member disposed vertically downward from the front end of the support plate, a convex connecting portion disposed on the back side of the storage box and formed by a plurality of radially arranged bumps, a reinforcing ridge disposed in an upright direction and extended from top to bottom to the support plate and the pressing member, and a connecting hole formed on the front side of the storage box. Surfaces of the binding block and the power winch for motor vehicles are integrally formed, and a concave connecting portion is disposed on the front side of the binding block and formed by a plurality of radially arranged grooves, the concave connecting portion and the convex connecting portion have symmetrical concave and convex portions with respect to each other, and a connecting hole is formed at the middle of the binding block. The support block is a transverse long-strip object having a connecting hole formed separately at both ends of the support block and a buffer space concavely formed at the middle of the support block, the support block disposed on the bottom surface of the back side of the storage box. A connecting member is passed through the connecting hole of the support block and coupled to the back side of the storage box through a fixed locking connection. The convex connecting portion disposed on the back side of the storage box and the concave connecting portion of the binding block are configured to correspond to each other, and a connecting member is passed through the connecting hole of the storage box and the connecting hole of the binding block for a fixed locking connection. The storage space of the storage box is provided for containing a wireless handheld controller, so that the two positioning grooves formed on the back side of the wireless handheld controller abut the slight flange of the storage box, and the lower arc wall on both sides, the protective wall, the support plate, and the bracket jointly cover and store the wireless handheld controller.

According to the above mentioned power winch for motor vehicles, the pressing member is pressed by a user's hand, so that the support plate links and moves the bracket on both sides to move in a direction towards the buffer space, and the slight flange is detached from the two positioning grooves formed on the back side of the wireless handheld controller in order to take out the wireless handheld controller.

According to the above mentioned power winch for motor vehicles, the power winch for motor vehicles is coupled to a vehicle power supply, has an electric control module installed thereto, and is electrically coupled with the power source and the connected vehicle power supply. The power winch for motor vehicles surface has a display panel mounted thereon and is electrically coupled to the electric control module. The display panel surface includes a power indicating light, a wireless remote control indicating light, a steel wire rope direction indicating area, a manual control button and a power switch button. The power indicating light shows the voltage of the connected vehicle power supply, the wireless remote control indictor light shows whether or not a wireless handheld controller is matched with the electric control module of the power winch for motor vehicles for use, the steel wire rope direction indicating area indicates the moving direction of the steel wire rope, the manual control button is pressed to control unwinding or winding the steel wire rope, and the power switch button is pressed to control the power connection between the power winch for motor vehicles and the connected vehicle power supply.

According to the above mentioned power winch for motor vehicles, the display panel is installed with an oblique angle between the front side and the top side of the power winch for motor vehicles.

According to the above mentioned power winch for motor vehicles, the power indicating light includes a plurality of blocks, and the quantity of lit blocks corresponds to the voltage magnitude of the connected vehicle power supply.

According to the above mentioned power winch for motor vehicles, the steel wire rope direction indicating area is divided into an upwards area sign and a downwards area sign, and the upwards area sign has an upwards arrow and an "OUT" sign, and the downwards area sign has a downwards arrow and an "IN" sign.

According to the above mentioned power winch for motor vehicles, both upwards area sign and downwards area sign have a bright light added thereto for showing the moving direction of the steel wire rope

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
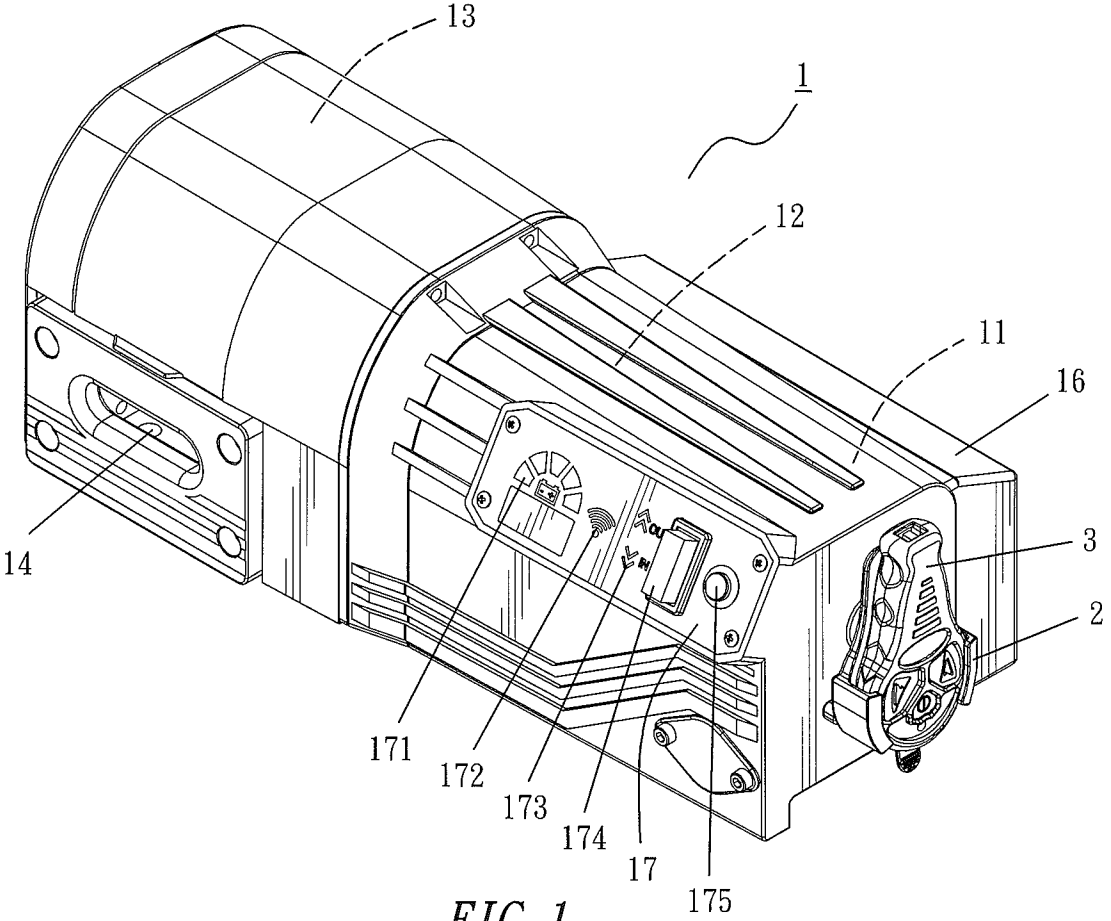
FIG. 1 is a perspective view of a power winch for motor vehicles in accordance with an embodiment of the present invention.
Figure 2:
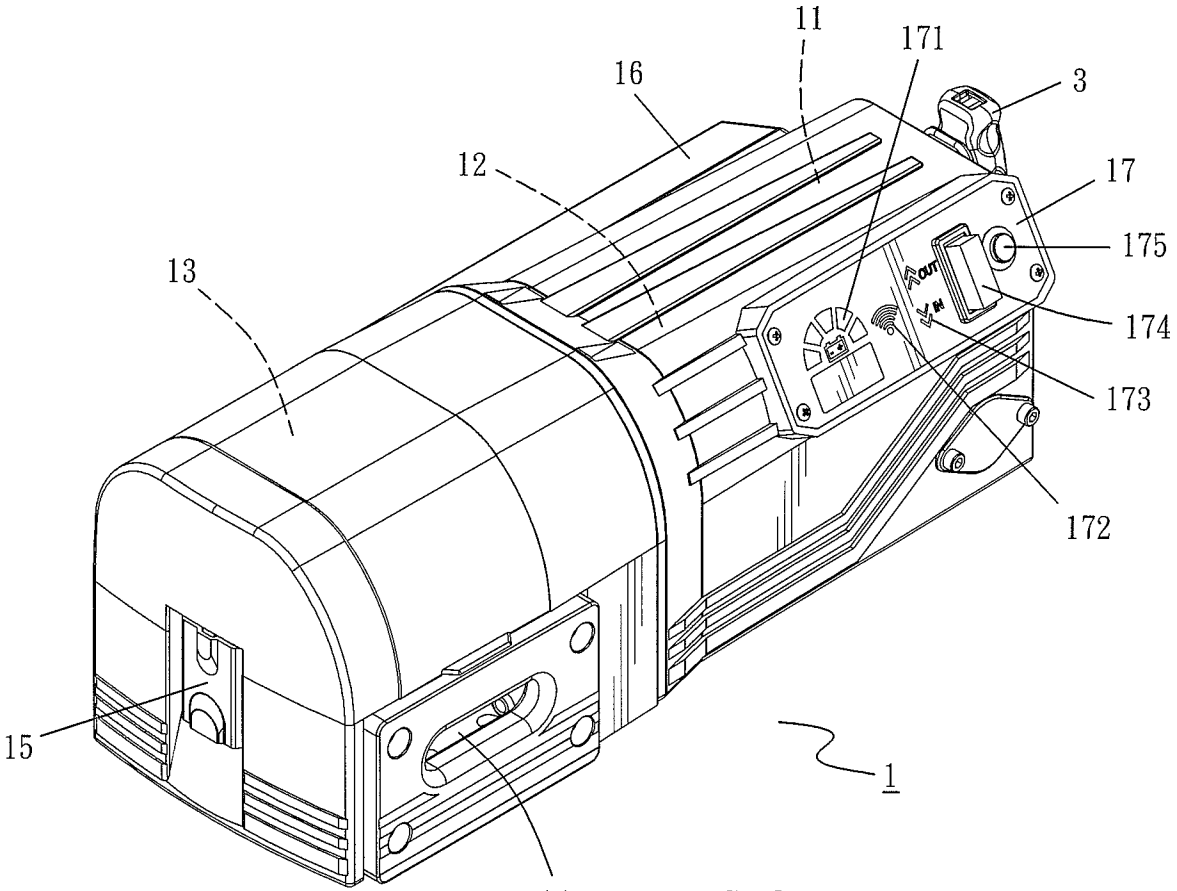
FIG. 2 is another perspective view of a power winch for motor vehicles in accordance with an embodiment of the present invention.
Figure 3:
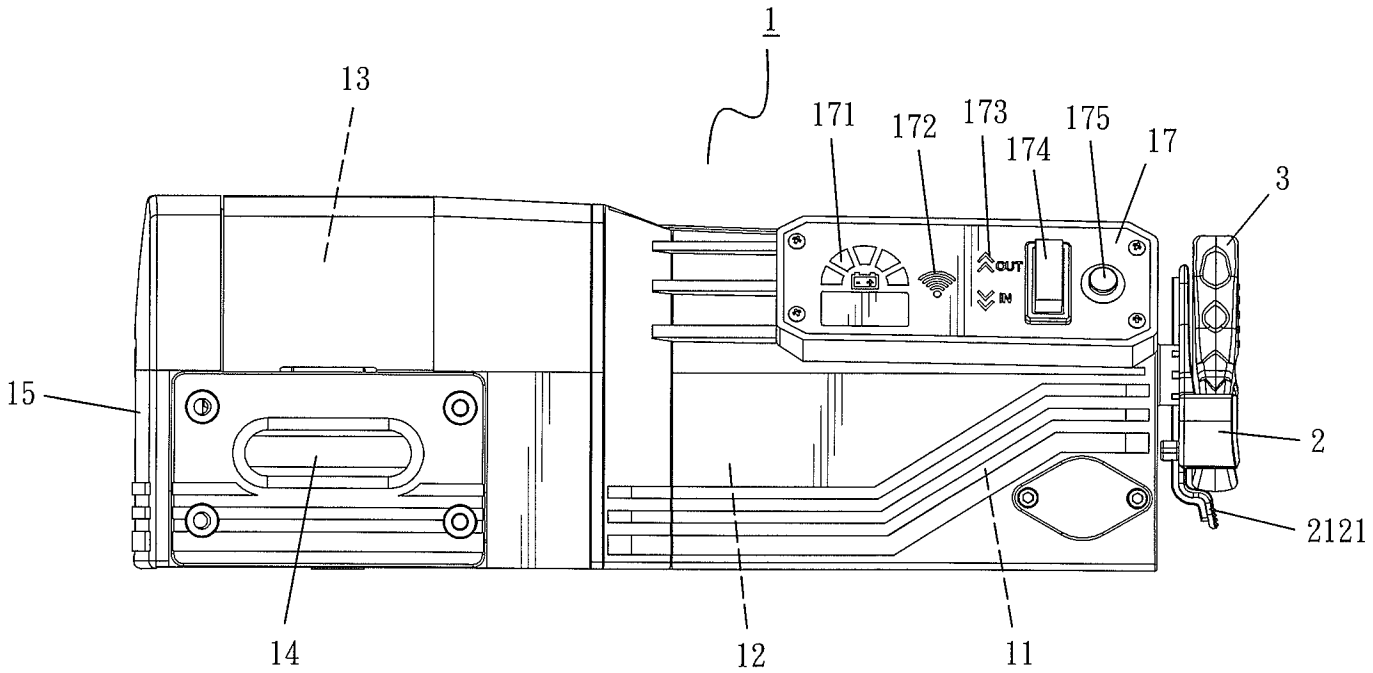
FIG. 3 is a front view of a power winch for motor vehicles in accordance with an embodiment of the present invention.

With reference to FIGS. 1-3 for a power winch for motor vehicle in accordance with an embodiment of the present invention, the power winch 1, the power winch is installed to a motor vehicle and includes a power source 11 (such as a DC motor) installed on a side in the power winch 1 and for driving a rope pulley 13 installed on the other side of the power winch to rotate by the power generated by the power source 11 and acted by a deceleration mechanism 12, so that a steel wire rope wound around the rope pulley 13 may perform a forward-rotation release or a reverse-rotation winding, so as to perform a winding or unwinding operation of the steel wire rope through a steel wire rope exit 14. The power winch 1 further includes a clutch wrench 15 installed on a side of the rope pulley 13. If necessary, the clutch wrench 15 may be turned and displaced out of position to disconnect the power from the rope pulley 13, so that users may pull the steel wire rope manually and quickly to hook a heavy object (such as a person or an object waiting to be rescued), and then the clutch wrench 15 is returned to its original position, so as to reconnect the power with the rope pulley 13. Therefore, the steel wire rope together with the heavy object hooked thereon can be pulled back. To control the operation sequence and operation time of the power winch 1, an electric control module 16 may be installed on the rear side of the power winch 1 and the electric control module 16 is electrically coupled to the power source 11 and the connected vehicle power supply.

The power winch 1 further includes a display panel 17 installed at an oblique angle between the front side and the top side of the power winch 1, and the display panel 17 is electrically coupled to the electric control module 16, and a surface of the display panel 17 includes a power indicating light 171, a wireless remote control indicating light 172, a steel wire rope direction indicating area 173, a manual control button 174 and a power switch button 175. The power indicating light 171 includes a plurality of blocks, and the number of lit blocks corresponds to the voltage magnitude of the connected vehicle power supply. The wireless remote control indicating light 172 is lit when the wireless handheld controller 3 matches with the electric control module 16 of the power winch 1 for use. The steel wire rope direction indicating area 173 may be divided into an upwards area sign and a downwards area sign, and the upwards area sign may further have an "OUT" sign in addition to an upwards arrow, if necessary, or add a bright light for showing the moving-out direction of the steel wire rope. Similarly, the downwards area sign may further have an "IN" sign in addition to a downwards arrow, if necessary, or add a bright light for showing the rewinding direction of the steel wire rope. The manual control button 174 is provided for operators to select a direct upward press or a direct downward press to release or rewind the steel wire rope, and the power switch button 175 is pressed once before use, so that the power winch 1 is electrically coupled (CLOSE) to the connected vehicle power supply to turn on the power winch 1. When the power switch button 175 is pressed again, the power winch 1 is electrically disconnected (OPEN) from the vehicle power supply to turn off the power winch 1.

Figure 4:
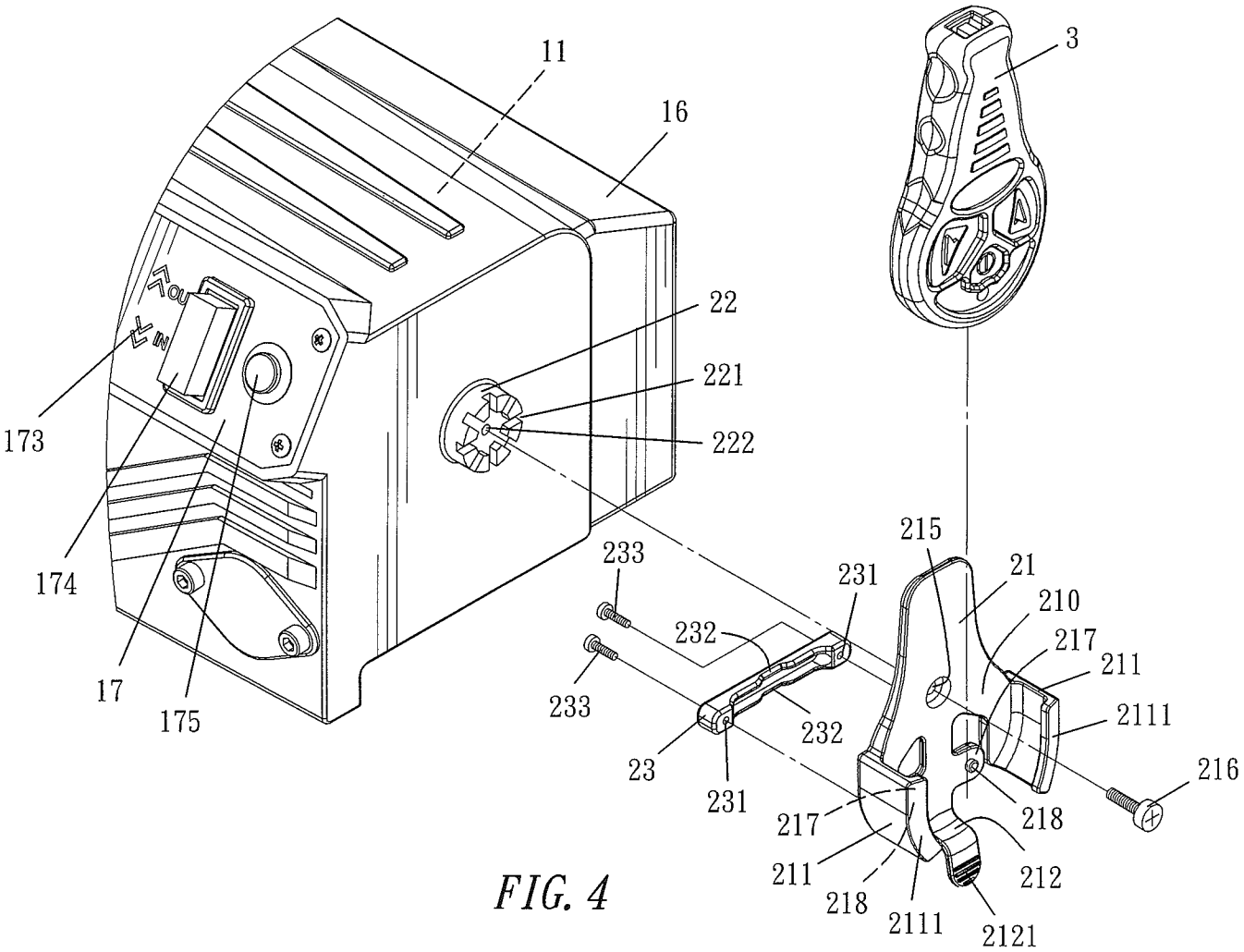
FIG. 4 is an exploded view of a partial structure of a power winch for motor vehicles in accordance with an embodiment of the present invention.
Figure 5:
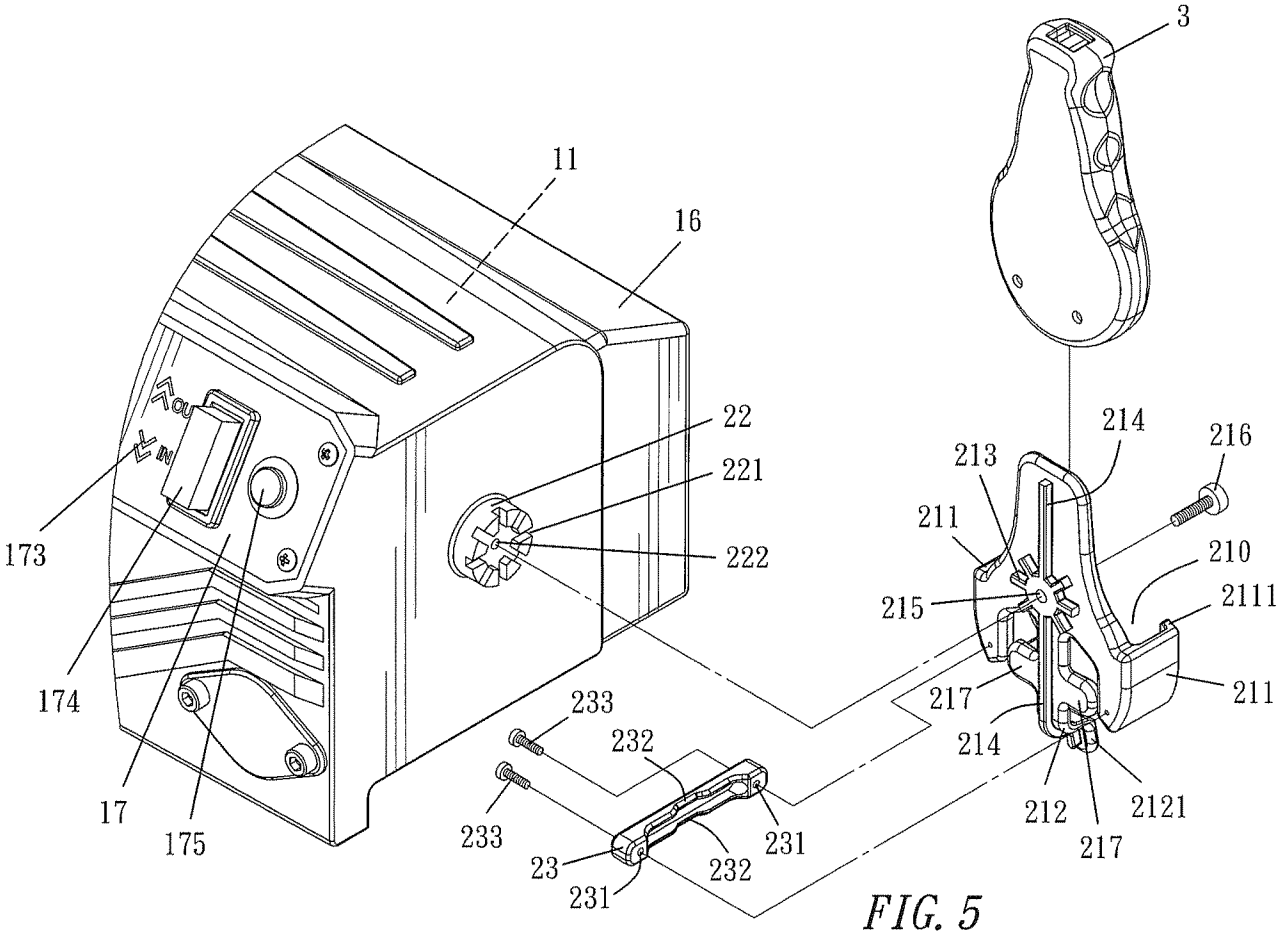
FIG. 5 is another exploded view of a partial structure of a power winch for motor vehicles in accordance with an embodiment of the present invention.

With reference to FIGS. 4 and 5, a storage holder 2 is installed on the other side of the power winch 1 (away from the other side of the clutch wrench 15) for storing a wireless handheld controller 3. The storage holder 2 includes a storage box 21, a binding block 22 and a support block 23, with a storage space 213 at the front side of the storage box 21 defined by a lower arc wall 211 connected to both sides of the storage box 21 and extended forward and a support plate 212 extended forward from a bottom side of the storage box 21. The front edge of the lower arc wall 211 is bent inwardly by a small section of protective wall 2111 for providing better storage. A bracket 217 is disposed at the top of the support plate 212 and extended towards both sides and each bracket 217 has a slight flange 218 provided for positioning, and a pressing member 2121 is disposed vertically downward from the front end of the support plate 212. Due to the property of a resin material, the support plate 212, the bracket 217 and the pressing member 2121 are elastic. The storage box 21 includes a convex connecting portion 213 disposed on the back side of the storage box 21 and formed by a plurality of radially arranged bumps, a reinforcing ridge 214 formed at the upright direction and extended from top to bottom to the support plate 212 and the pressing member 2121, and a connecting hole 215 formed on the front side of the storage box 21. The sides of the binding block 22 and the power winch 1 are integrally formed (by a resin injection molding method), and a concave connecting portion 221 is disposed on the front side of the binding block 22 and formed by a plurality of radially arranged grooves. The concave connecting portion 221 and the convex connecting portion 213 disposed on the back side of the storage box 21 are symmetrical concave and convex portions. The binding block 22 has a connecting hole 222 formed at the middle of the binding block 22, and a corresponding connecting member (such as a nut) may be embedded into the connecting hole 222. The support block 23 is a transverse long-strip object with a connecting hole 231 separately formed at both ends of the support block 23, and a concave space 232 formed at the middle of the support block 23.

When the storage holder 2 is installed, the support block 23 is mounted at a corresponding position of the bottom of the back side of the storage box 21, and a connecting member 233 (such as a bolt) is passed through the corresponding connecting hole 231 and coupled to the back side of the storage box 21 by a fixed locking connection, and the convex connecting portion 213 on the back side of the storage box 21 is configured to be corresponsive to the concave connecting portion 221 of the binding block 22. A connecting member 216 (such as a bolt) is then passed through the connecting hole 215 of the storage box 21 and coupled to the connecting hole 222 of the binding block 22 by a fixed locking connection, so that the storage holder 2 is installed at a predetermined position on a side of the power winch 1. It is noteworthy that when the storage holder 2 is installed, the opening of the storage space 213 is not limited to be facing upward, but it can be arranged to be facing any direction according to the user's selection or the space provided by a particular model of the motor vehicle.

During use, a wireless handheld controller 3 is contained in the storage space 213 of the storage box 21 and pressed appropriately, so that two positioning grooves (as shown in FIG. 5) formed on the back side of the wireless handheld controller 3 abut precisely against the slight flange 218 of the storage box 21 to achieve the positioning effect for the storage. Now, the lower arc wall 211 on both sides, the protective wall 2111, the support plate 212 and the bracket jointly provide the effect of covering and storing the wireless handheld controller 3 as shown in FIGS. 1 and 3.

When it is necessary to take out the wireless handheld controller 3, a user simply presses the pressing member 2121 by hand, so that the support plate 212 links the bracket 217 on both sides to move slightly in a direction towards the buffer space 232, so that the slight flange 218 is slightly detached from the two positioning grooves formed on the back side of the wireless handheld controller 3, and then a force is applied slightly to pull the wireless handheld controller 3 to the outside, so as to take out the wireless handheld controller 3 easily. In general, the wireless handheld controller 3 has a power button, an "IN" button, an "OUT" button, and a light signal with a variable color temperature, but the invention is not limited to such arrangement only.

The power winch 1 in accordance with an embodiment of the present invention provides a selection between two modes, respectively: a "manual control" and a "wireless remote control". If the "manual control" mode is selected, an operator has to come near to the power winch 1 and press the power switch button 175 of the display panel 17 once by hand to electrically connect (CLOSE) the power winch 1 and the vehicle power supply to turn on the power winch 1. Now, the power indicating light 171 will be lit to let the operator and viewer know that the power winch 1 has been electrically connected and it is necessary to pay attention to the safety of use. The power indicating light 171 will light up a number of blocks according to the voltage magnitude of the connected vehicle power supply. The more the lit blocks, the greater the voltage, and the less the lit blocks, the smaller the voltage. While the power indicating light 171 is lit, the wireless remote control indicating light 172 also starts blinking for a period of time (such as 1 minute), and it indicates that the electric control module 16 of the power winch 1 is waiting to compare the code with a wireless handheld controller 3. Since the "wireless remote control" mode is not selected at this moment, the wireless remote control indicating light 172 will blink for a period of time before turning off (or shutting down the waiting of the code). The operator may then press the manual control button 174 downward, so that the forward rotation of the power source 11 drives the steel wire rope to be released from the steel wire rope exit 14 by power. Now, the upwards area sign (arrowhead) in the steel wire rope direction indicating area 173, the "OUT" sign and the bright light (if installed) allow the operator and viewer to clearly know that the power winch 1 now releases the steel wire rope by power. On the other hand, if the manual control button 174 is pressed down, then the reverse rotation of the power source 11 will withdraw the steel wire rope from the steel wire rope exit 14. Now, the downwards area sign (arrowhead), the "IN" sign and the bright light (if installed) in the steel wire rope direction indicating area 173 allow the operator and viewer to clearly know that the power winch 1 now withdraws the steel wire rope by power, so that the operator and viewer have to be very careful not to stumble on the moving steel wire rope. Finally, the power switch button 175 disposed on the display panel 17 is pressed again after the use of the power winch 1 is completed, so as to disconnect (OPEN) the power connection between the power winch 1 and the vehicle power supply. Now, the bright lights (if installed) of the power indicating light 171 and the steel wire rope direction indicating area 173 will be off.

If the "wireless remote control" mode is selected, it is necessary to follow the above steps to remove the wireless handheld controller 3 from the storage holder 2 and get ready for its use. The wireless handheld controller 3 generally has a power button, an "IN" button, an "OUT" button and a light signal with a variable color temperature (but the invention is not limited to such arrangement). Similarly, the power switch button 175 disposed on the display panel 17 is pressed once to connect (CLOSE) the power between the power winch 1 and the vehicle power supply to turn on the power winch 1. Now, the power indicating light 171 is lit. In the meantime, the wireless remote control indicating light 172 starts blinking (waiting for the code). If the power button on the wireless handheld controller 3 has been pressed for a period of time (such as five seconds), then a green light of the wireless handheld controller 3 will be lit, and such green light indicates that the wireless handheld controller 3 is electrically connected and turned on. Meanwhile, the wireless handheld controller 3 has complete the code comparison with the electric control module 16 of the power winch 1, so that the wireless remote control indicating light 172 on the display panel 17 is lit all the time. It is noteworthy that the first time of use (in general, the first time of use refers to the completion of testing by manufacturers), the "IN" button and the "OUT" button on the wireless handheld controller 3 have to complete the code comparison and storage with the electric control module 16 of the power winch 1 for the continuous use. Once the power winch is turned on, the "IN" button and the "OUT" button will compare the code directly, and the operator just needs to press the "IN" button or "OUT" button on the wireless handheld controller 3 directly, so that the electric control module 16 of the power winch 1 instructs the power source 11 to perform a forward-rotation release of the steel wire rope or a reverse-rotation winding of the steel wire rope. In the meantime, the light of the wireless handheld controller 3 is changed to a red light to indicate an ongoing operation. After the use of the power winch 1 is completed, the power button on the wireless handheld controller 3 is pressed for a period of time (such as five seconds), and then the light of the wireless handheld controller 3 will be turned off, indicating that the power of the wireless handheld controller 3 is disconnected and the power winch 1 is turned off. In the meantime, it is necessary to press the power switch button 175 on the display panel 17 once again, so as to disconnect (OPEN) the electric power between the power winch 1 and vehicle power supply and turn off the power winch 1. Therefore, the bright lights (if installed) of the power indicating light 171, the wireless remote control indicating light 172 and the steel wire rope direction indicating area 173 will be turned off.

In summation of the description above, the operator and viewer may clearly know about the following situations from the operation status displayed on the display panel 17: (1) Whether or not the power winch for motor vehicles 1 is electrically connected and being used; (2) The voltage magnitude of the vehicle power supply connected to the power winch for motor vehicles 1; (3) whether or not the connection (code comparison) between the wireless handheld controller 3 and the power winch for motor vehicles 1 is normal; and (4) The power winch for motor vehicles 1 is situated at a status of releasing the steel wire rope or rewinding the steel wire rope. If the operator and viewer can clearly know the operation status of the power winch for motor vehicles 1 through the display panel 17, then the operation, control and use is safer in the surrounding environment. In addition, the present invention comes with a special design of the storage holder 2 installed on a side of the power winch for motor vehicles 1 for storing the wireless handheld controller 3, so that the users can access the wireless handheld controller 3 quickly from a fixed position and avoid the embarrassing situation of being unable to find the wireless handheld controller 3. Obviously, the invention can improve the convenience of use.

In summation of the description above, the power winch for motor vehicles in accordance with the present invention can display the operation status clearly and provides a storage holder for storing a wireless handheld controller, so as to improve the safety and convenience of use.

While the invention has been described by means of specific embodiments, numerous modifications and variations could be made thereto by those skilled in the art without departing from the scope and spirit of the invention set forth in the claims.

What is claimed is:

1. A power winch comprising:

an internal power source;

a deceleration mechanism;

a rope pulley configured to rotate after power generation by said internal power source and an action of the deceleration mechanism; and a storage holder configured to store a wireless handheld controller, wherein a steel wire rope is released or wound around the rope pulley through a steel wire rope exit, and wherein the storage holder is comprised of a storage box having a front side, a back side, and a bottom side, a binding block and a support block, and wherein a storage space at the front side of the storage box is defined by a lower arc wall connected to both of two sides extending from opposite ends of the front side of the storage box and extended forward and a support plate extended forward from the bottom side, and a front edge of the lower arc wall is bent inwardly into a small section of protective wall, and the support plate has a bracket disposed at a top of the support plate and extended towards both sides of the support plate, and wherein the bracket comprises a slight flange used for positioning, a pressing member disposed vertically downward from a front end of the support plate, and a convex connecting portion disposed on the back side of the storage box and formed by a plurality of radially arranged bumps, a reinforcing ridge disposed in an upright direction and extended from top to bottom of the support plate and to the pressing member, and a connecting hole formed on the front side of the storage box;

wherein surfaces of the binding block and the power winch are integrally formed, and a concave connecting portion is disposed on the front side of the binding block and formed by a plurality of radially arranged grooves, and the concave connecting portion and the convex connecting portion are symmetrical with respect to each other, and a connecting hole is formed at a middle of the binding block;

wherein the support block is a transverse long-strip object having a connecting hole formed separately at opposite ends of the support block and a buffer space is concavely formed at a middle of the support block, and wherein the support block is disposed on a bottom surface of the back side of the storage box, and a connecting member is passed through the connecting hole of the support block and coupled to the back side of the storage box through a fixed locking connection;

wherein the convex connecting portion disposed on the back side of the storage box and the concave connecting portion of the binding block are configured to be corresponsive to each other, and a connecting member is passed through the connecting hole of the storage box and the connecting hole of the binding block for a fixed locking connection, and the storage space of the storage box is provided for containing the wireless handheld controller, so that two positioning grooves formed on a back side of the wireless handheld controller abut the slight flange of the storage box, and wherein the lower arc wall on both sides, the protective wall, the support plate, and the bracket jointly cover and store the wireless handheld controller.

2. The power winch according to claim 1, wherein the pressing member is configured such that the support plate links and moves the bracket on both sides to move in a direction towards the buffer space, and the slight flange is detached from the two positioning grooves formed on the back side of the wireless handheld controller in order to remove the wireless handheld controller.

3. The power winch according to claim 1, wherein the power winch is coupled to a vehicle power supply and has an electric control module installed thereto, and is electrically coupled with the internal power source and the connected vehicle power supply, and wherein a surface of the power winch has a display panel mounted thereon and electrically coupled to the electric control module, and the display panel surface comprises: a power indicating light, a wireless remote control indicating light, a steel wire rope direction indicating area, a manual control button and a power switch button; the power indicating light shows the voltage of the connected vehicle power supply, and the wireless remote control indicating light shows whether or not the wireless handheld controller is matched with the electric control module of the power winch for motor vehicles for use, and the steel wire rope direction indicating area indicates a moving direction of the steel wire rope, and the manual control button is configured to control unwinding or winding the steel wire rope, and the power switch button is configured to control a power connection between the power winch and the connected vehicle power supply.

4. The power winch according to claim 3, wherein the display panel is installed with an oblique angle between a front side and a top side of the power winch.

5. The power winch according to claim 3, wherein the power indicating light is comprised of a plurality of blocks, and the quantity of lit blocks corresponds to the voltage magnitude of the connected vehicle power supply.

6. The power winch according to claim 3, wherein the steel wire rope direction indicating area is divided into an upwards area sign and a downwards area sign, and the upwards area sign has an upwards arrow and an "OUT" sign, and the downwards area sign has a downwards arrow and an "IN" sign.

7. The power winch according to claim 6, wherein both upwards area sign and downwards area sign have a bright light added thereto for showing the moving direction of the steel wire rope.

* * * * *